US010604905B2

(12) United States Patent
Ouyang

(10) Patent No.: US 10,604,905 B2
(45) Date of Patent: Mar. 31, 2020

(54) MULTIFUNCTIONAL WALL CLAMPING DEVICE OF STATIC PILING MACHINE

(71) Applicants: Ganlin Ouyang, Qingdao (CN); QINGDAO JINGLI ENGINEERING CO., LTD., Qingdao (CN)

(72) Inventor: Ganlin Ouyang, Qingdao (CN)

(73) Assignee: Qingdao Jingli Engineering Co., Ltd., Qingdao (CN)

( * ) Notice: Subject to any disclaimer, the term of this patent is extended or adjusted under 35 U.S.C. 154(b) by 10 days.

(21) Appl. No.: 15/747,098

(22) PCT Filed: Aug. 26, 2015

(86) PCT No.: PCT/CN2015/088117

§ 371 (c)(1),
(2) Date: Jan. 23, 2018

(87) PCT Pub. No.: WO2017/012171

PCT Pub. Date: Jan. 26, 2017

(65) Prior Publication Data

US 2018/0298579 A1 Oct. 18, 2018

(30) Foreign Application Priority Data

Jul. 23, 2015 (CN) ..... 2015 1 0437162

(51) Int. Cl.
*E02D 7/02* (2006.01)
*B63B 21/26* (2006.01)
(Continued)

(52) U.S. Cl.
CPC ..... *E02D 7/20* (2013.01); *E02D 5/32* (2013.01); *E02D 5/54* (2013.01); *E02D 29/16* (2013.01)

(58) Field of Classification Search
CPC .... E02D 7/20; E02D 5/54; E02D 5/32; E02D 29/16
(Continued)

(56) References Cited

U.S. PATENT DOCUMENTS 2,256,454 A * 9/1941 Bomar ..... B66F 9/19 414/661
3,279,195 A * 10/1966 Taylor ..... E02D 11/00 405/232

(Continued)

*Primary Examiner* — Benjamin F Fiorello
*Assistant Examiner* — Edwin J Toledo-Duran
(74) *Attorney, Agent, or Firm* — Liang Legal Group, PLLC

(57) ABSTRACT

A multifunctional wall clamping device includes a wall-clamping platform, a main body, and a wall-pressing device, wherein the main body has a center hole. The wall-pressing device includes a wall-pressing hydraulic cylinder disposed on an upper support, and a jacking cylinder disposed on a lower support. The wall-clamping platform includes two U-shape pincer boxes with a same geometry and a U-shaped horizontal cross section. The U-shape pincer boxes are arranged with openings facing each other on the same axis to form a combination with a rectangular cross section. A piston rod of the wall-pressing hydraulic cylinder is connected to a top of the wall-clamping platform such that the wall-clamping platform is vertically suspended in the center hole. Outside walls of the wall-clamping platform include roller wheels, which can roll on inner walls of the center hole and inner walls of rectangular columns of the upper support and the lower support.

8 Claims, 7 Drawing Sheets

(51) Int. Cl.

| | |
|---|---|
| ***E02D 7/20*** | (2006.01) |
| ***E02D 5/32*** | (2006.01) |
| ***E02D 5/54*** | (2006.01) |
| *E02D 29/16* | (2006.01) |

(58) Field of Classification Search
USPC ..... 405/228, 230–257
See application file for complete search history.

(56) References Cited

U.S. PATENT DOCUMENTS

| | | | | | |
|---|---|---|---|---|---|
| 3,291,227 | A * | 12/1966 | Bodine, Jr. | E02D 7/18 | 175/55 |
| 3,352,369 | A * | 11/1967 | Bodine, Jr. | E02D 7/18 | 175/56 |
| 3,368,632 | A * | 2/1968 | Lebelle | E02D 11/00 | 173/49 |
| 3,657,896 | A * | 4/1972 | Ishihara | E02D 7/20 | 405/232 |
| 3,763,654 | A * | 10/1973 | Matsushita | E02D 7/20 | 405/232 |
| 3,871,617 | A * | 3/1975 | Majima | E02D 7/20 | 254/29 R |
| 3,927,861 | A * | 12/1975 | Dumont | E02D 7/26 | 254/29 R |
| 4,094,156 | A * | 6/1978 | Dumont | E02D 7/20 | 405/274 |
| 5,135,335 | A * | 8/1992 | Stephens | E02D 7/20 | 405/229 |
| 9,850,110 | B2 * | 12/2017 | Cox | B66C 23/202 | |
| 2007/0065235 | A1 * | 3/2007 | Glass | E02D 5/03 | 405/276 |

* cited by examiner

④

MULTIFUNCTIONAL WALL CLAMPING DEVICE OF STATIC PILING MACHINE

TECHNICAL FIELD

The invention belongs to the field of static press-in technology for underground space development, especially relates to multifunctional wall-clamping device for a static pile driver. The wall-clamping equipment can drive many new types of piles and is installed on a fully hydraulic static pile driver and, by clamping a wall-forming equipment set, can construct underground continuous walls (diaphragm walls).

BACKGROUND

Domestic hydraulic static pile drivers (hereinafter, static pile drivers) use pile clamping equipment installed in the machine body to hold arc-shaped piles (usually cylindric piles) or rectangular piles (usually square piles) when constructing piles. Such a machine typically only drives a pile each time. It can't drive two piles and can't clamp a wall-forming sets to construct a press-in diaphragm wall. Therefore, their limited applicability and poor resource utilization are apparent. There is an urgent need to solve these technical defects with a new technical solution.

SUMMARY OF THE INVENTION

An object of this invention is to provide multifunctional wall-clamping devices for static pile drivers. A device of the invention can hold two piles at the same time or a wall-forming equipment set.

In order to achieve the above object, a device of the invention comprises a wall-clamping platform/rig, a main body, and a wall-pressing device. The main body has a vertical through hole ("main body hole") at its center running from top to bottom. The wall-pressing device comprises a wall-pressing hydraulic cylinder, an upper support, a lower support, and a jacking cylinder. The wall-pressing device is installed on the main body. The wall-clamping rig comprises two identical pincer-shaped boxes (pincer boxes), the horizontal cross sections of which are in the form of a "concave" shape (e.g., "U" shape), the openings of which are arranged to face each other and are coaxially arranged to form a rectangular cross-section. Roller wheels (rollers) are mounted on the side walls of the pincer-shaped boxes. The top surface of the wall-clamping platform/rig is hinged on the wall-pressing hydraulic cylinder and vertically suspended in the center through hole of the main body. The wall-clamping platform can move up and down in the main body center hole, with the retraction and extension of the piston of the wall-pressing hydraulic cylinder.

The multi-functional wall-clamping device comprises a wall-clamping platform/rig and a wall-pressing device.

The wall-clamping platform comprises two U-shape pincer-like boxes (pincer boxes/casings) of the same geometric dimensions, which have the same horizontal "concave" ("U") shape cross section. The openings of the U shapes are arranged to face each other along the same axis to form a rectangular shape. The long side of the U-shaped clamps is called a clamp arm. The non-opening side (i.e., the bottom part of "U") is referred to as the clamp body (or clamp bottom), while the open end (of the clamp arm) is referred to as a clamp end. The clamp arm, clamp body, and clamp end are the three components constituting a single pincer box (or pincer casing). The dimensions of a single pincer box (or clamp casing) are as follows: the clamp arm length: 500 mm-2500 mm, clamp body width: 450 mm-2000 mm, and the vertical thickness: 800 mm-3500 mm. The shape and size of the outer wall of the wall-clamping platform/rig correspond to those of the inner walls of the center hole in the static pile driver (hereinafter referred to as a main body center hole, or center hole). The top face of the wall-clamping platform/rig is hingedly connected with the corresponding wall-pressing cylinder piston rod, thereby the wall-clamping rig is vertical suspended in the corresponding main body hole. The wall-clamping rig can move up and down with the wall-pressing cylinder piston rod and with the aid of rolling wheels on the four sidewalls moving on the inner walls of the main body hole and the corresponding inner wall of the rectangular column. Pincer-shaped box is made of a combination of steel plates and several support ribs are welded at internal force-bearing parts to form a network-like rectangular steel structure to increase the strength of the pincer-shaped box.

Rolling wheels (rollers) are evenly and orderly arranged in rows and columns with a selected spacing on the four walls of the wall-clamping rig, within an effective area corresponding to the contact surface with the four side walls of the main body hole. The rolling wheel has a cylindrical shape, and a roller axle is provided at the axis of the cylindrical shape. The rolling wheel is free to rotate around the roller axle under external force, and both ends of the roller axle of the rolling wheels (rollers) are arranged in support seats on the outer wall of the wall-clamping rig. The surface of the roller extrudes beyond the side wall surface and makes close contact with the inner walls of the main body hole and the inner walls of the rectangular column. The roller can be fined tuned in the support seat within a certain range of horizontal displacement to compensate for excessive gaps, due to progressive wear of the roller surface, with the inner walls of the main body hole and the rectangular column, thereby avoiding excessive deviation when the wall-clamping rig moves up and down. Rollers are also disposed at a fixed spacing along the clamp face effective areas of the two facing clamp ends, thereby converting the surface sliding friction into rolling friction.

Horizontal jacking cylinders are arranged on the surface of one of the clamp arms of the clamp box. The front end of the piston rod of the horizontal jacking cylinder is ball-head that is hingedly connected with the back of an active clamping plate, i.e., seated into a semi-spherical concave on the back of the active clamping plate and held in place with two hemispherical cover plates with a certain thickness forming a center passage hole with a diameter larger than the piston rod diameter but smaller than the diameter of the piston rod ball head. The hemispherical cover plates, which are fastened to the active clamping plate with bots, hold the piston rod ball head in place and sleeve over the neck of the piston rod. Because the diameter of the piston rod ball head is larger than the diameter of the center passage hole of the hemispherical cover plates, the piston rod ball head will not fall off, but can move in all directions. The other inner side wall of the clamping arm is provided with a passive clamping plate, which has a trapezoidal ridge on the back side running in the horizontal direction. The trapezoidal ridge fits snuggly in a corresponding trapezoidal groove in the inner side wall of the clamp arm, and the passive clamping plate is fixed on the other arm of the clamping arm with bolts such that it will not move. The number of the active clamping plates matches that of the passive clamping plates, and their corresponding positions and sizes are exactly the same. Horizontal jacking cylinders are arranged in at least two rows horizontally along the inner wall of the clamp box arm, with each row having at least one. In a region corresponding to an effective area of an active clamping plate, there may be a single horizontal jacking cylinder, a pair of horizontal jacking cylinders, 3 horizontal jacking cylinders, or multiple horizontal jacking cylinders. A set of multiple horizontal jacking cylinders can evenly distribute forces over the active clamping plate, and on-site installation and maintenance would be relatively easy and convenient.

When the piston rod of the horizontal jacking cylinder is extended, the active clamping plate is moved horizontally toward the passive clamping plate so that the horizontal distance between the two clamping plates is gradually reduced, resulting in gradually tightening the grip on the member located between the two clamping plates. When the piston rod of the horizontal jacking cylinder retracts, the active clamping plate moves horizontally away from the passive clamping plate causing the horizontal distance between the two clamping plates to increase, resulting in release of the clamped member. The clamping surfaces of the active clamping plate and the passive clamping plate are made to be curved, rectangular, wavy, or other shape according to the outer contour of the clamped member. The arc-shaped clamping plates are used for clamping a cylinder piles, and the rectangular clamping plates are used for rectangular piles or a rectangular wall-forming device. The wavy and trapezoidal clamping plates are respectively used for a wall-forming device or another member that has wavy or trapezoidal shapes on the surface. Unique shaped clamping plate is mainly designed for a unique outer contour clamped member. The active and passive clamping plates can be made in a variety of thicknesses to satisfy the different geometric dimensions of the clamped members.

The wall-pressing device comprises a wall-pressing (hydraulic) cylinder, an upper support, a lower support, and a jacking cylinder. The bottom of the wall-pressing cylinder is fixed via flange on a longitudinal beam on the upper support. The wall-pressing cylinders on the two pincer-shaped boxes (or clamp boxes) are correspondingly divided into two groups. Each group consists of at least one cylinder. The front end of the wall-pressing cylinder piston rod is a ball head, which is hingedly connected in a hemispheric concave on the top face of the clamp box. The hinge connection is in a manner identical to that for the connection of the horizontal jacking cylinder in a hemispheric concave on the back face of the active clamping plate. Thereby, the wall-clamping rig is vertically suspended, by the piston rod of the corresponding wall-pressing cylinder, in the corresponding main body hole. By controlling the extension or retraction of the cylinder piston, the clamp boxes are driven up and down in vertical movements. When a single wall-pressing cylinder corresponding to a clamp box moves up and down, only a single clamp box is moved via rolling wheels rolling up and down along the inner walls of the main body hole and the rectangular column of the upper support, while the other clamp box remains in place. When the two wall-pressing cylinders corresponding to the two clamp boxes work at the same time, extending the horizontal jacking cylinders to clamp one pile, two piles, or two wall-forming devices, the two clamp ends of the clamp boxes will realize synchronized same direction movement, or synchronized opposite direction movement, or non-synchronized same direction movement, or non-synchronized opposite direction movement, thereby achieving multiple functions of the wall-clamping rig. The upper support comprises two longitudinal beams arranged in parallel with the two clamp arms of the clamp box. The span of the longitudinal beams is greater than the sum of the axial lengths of the two clamp arms of the clamp box. The parallel spacing between the two longitudinal beams is slightly larger than the width of the clamp box body. The longitudinal beams are fixed at both ends with a flange fixed to the top of the rectangular column, and the rectangular column is fixed at the bottom with a flange to the main body near the edge of the main body hole, thereby forming two identical, parallel door-shaped upper supports. The span and the parallel spacing of the longitudinal beams of the upper supports are such that they will accommodate the maximum sized member cross-section and allow the member to move up and down or to move horizontally in the axial direction. The total height of the upper support is greater than the length of the wall-pressing cylinder itself+ total stroke length of the piston rod.

The lower supports are placed at the bottom of the main body near the edge of the main body hole at locations corresponding to the locations of the upper supports. The lower supports are fixedly connected, via both ends of lower longitudinal beams, to the bottom of the lower rectangular columns by flanges and bolts. The upper ends of the lower rectangular columns are bolted to the bottom surface of the main body by flanges to form inverted door-like (i.e., "U" shaped) structures. The span and the parallel spacing of the two lower longitudinal beams match those of the upper longitudinal beams at the top surface of the main body, and the height should allow the bottom of the jacking cylinder to have a sufficient clearance from the ground when the static pile driver travels. The jacking cylinder is vertically fixed to the bottom of the lower longitudinal beam at an appropriate position, corresponding to the bottom of the clamp arm of the clamp box, via the flange and bolts. The piston rod can extend up in vertical movement through a hole in the lower longitudinal beam. The front end of the piston of the jacking cylinder has a rectangular block with a larger in dimension than the cross section of the piston rod. When the piston rod of the jacking cylinder protrudes, an upward force is generated by the rectangular block and the lower support against the bottom side of the clamp arm of the clamp box. This upward force can help the wall-pressing cylinder when pulling up a wall-forming device or other components. The cross sections of the longitudinal beams of the upper supports and the rectangular columns are the same as those of the longitudinal beams of the lower supports and the lower rectangular columns. However, the upper and lower rectangular columns may have different lengths.

Effects of the Invention

1. Embodiments of the invention solve a key technology problem for the construction of a pressed-in type underground continuous wall;

2. In addition performing pressed-in underground continuous wall construction and retaining the original static pile driver functions, embodiments of the invention also have new functions: (1) pressing two piles simultaneously; (2) clamping a wall-forming device to press-in piles with linear profiles (i.e., rectangular cross section); (3) clamping a wall-forming device to press-in cross-shaped piles; (4) clamping a wall-forming device to press-in L-shaped piles; and (5) holding other components that meet the clamping conditions to be pressed into the ground. Thus, embodiments of the invention provide a static pile driver having a plurality of functions: pressing a wall, a pile, or two piles, achieving purposes of multiple functions, multiple applications, and resource-saving.

3. When two oppositely arranged clamp-type boxes are driven by corresponding wall-pressing cylinders, if the horizontal jacking cylinder is extended to clamp a pile or two piles or two wall-forming devices, it is possible to realize synchronous same-direction work, or synchronous opposite-direction work, or asynchronous same-direction work, or asynchronous opposite-direction work to achieve most functions among the same type of static pile drivers;

4. Jacking cylinder can significantly increase the power of the static pile driver when pulling the press-in wall-forming device from deep underground, thereby substantially saving power consumption.

In figures: 1 wall-clamping platform/rig; 2 pincer-like box/casing; 3 clamp arm; 4 clamp body; 5 clamp end; 6 main body hole; 7 wall-pressing hydraulic cylinder; 8 piston rod; 8 piston rod of the jacking cylinder; 9 rolling wheel (roller); 10 support rib; 11 roller axle; 12 bearing seat; 13 horizontal jacking cylinder; 13' double horizontal jacking cylinders; 13" three horizontal jacking cylinders; 13'" multiple horizontal jacking cylinders; 14 piston rod of a horizontal jacking cylinder; 15 piston rod ball head; 15' piston rod ball head of wall-pressing cylinder; 16 active clamping plate; 16' passive clamping plate; 17/17' hemispherical concave; 18 hemispherical cover; 19 bolt; 20 Trapezoidal ridge; 20' Trapezoidal groove; 21 arc-shaped clamping plate; 22 rectangular clamping plate; 23 wave-shaped clamping plate; 24 trapezoidal clamping plate; 25 upper support; 26 lower support; 27 jacking cylinder; 28 flange; 29/29' longitudinal beam; 30' rectangular column; 31 machine body (main body of static pile machine); 32 rectangular pad/block.

DETAILED DESCRIPTION

Embodiments of the present invention will be further described with the aid of the following drawings and examples.

Figure 1:
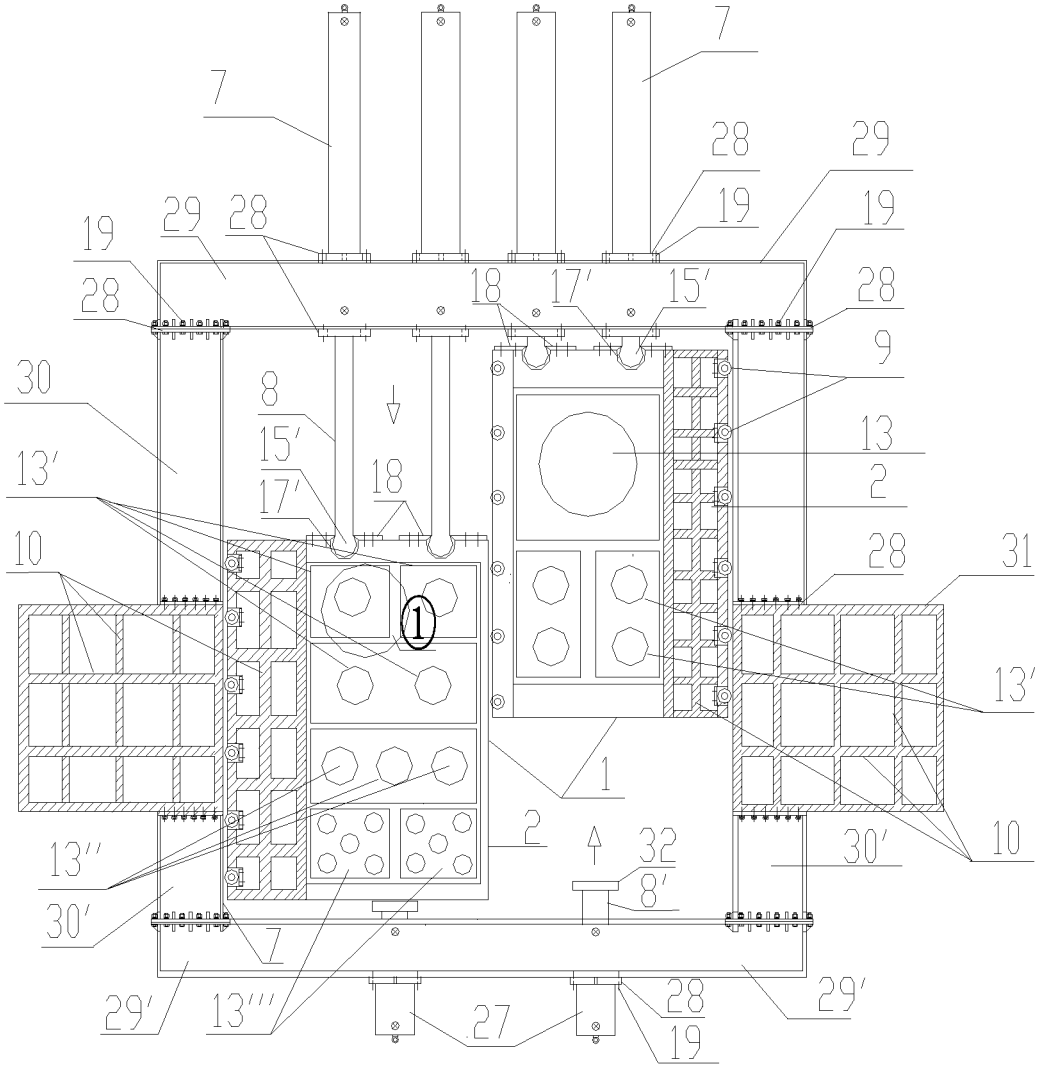
FIG. 1 shows a front sectional view of a multifunctional wall-clamping equipment.
Figure 4:
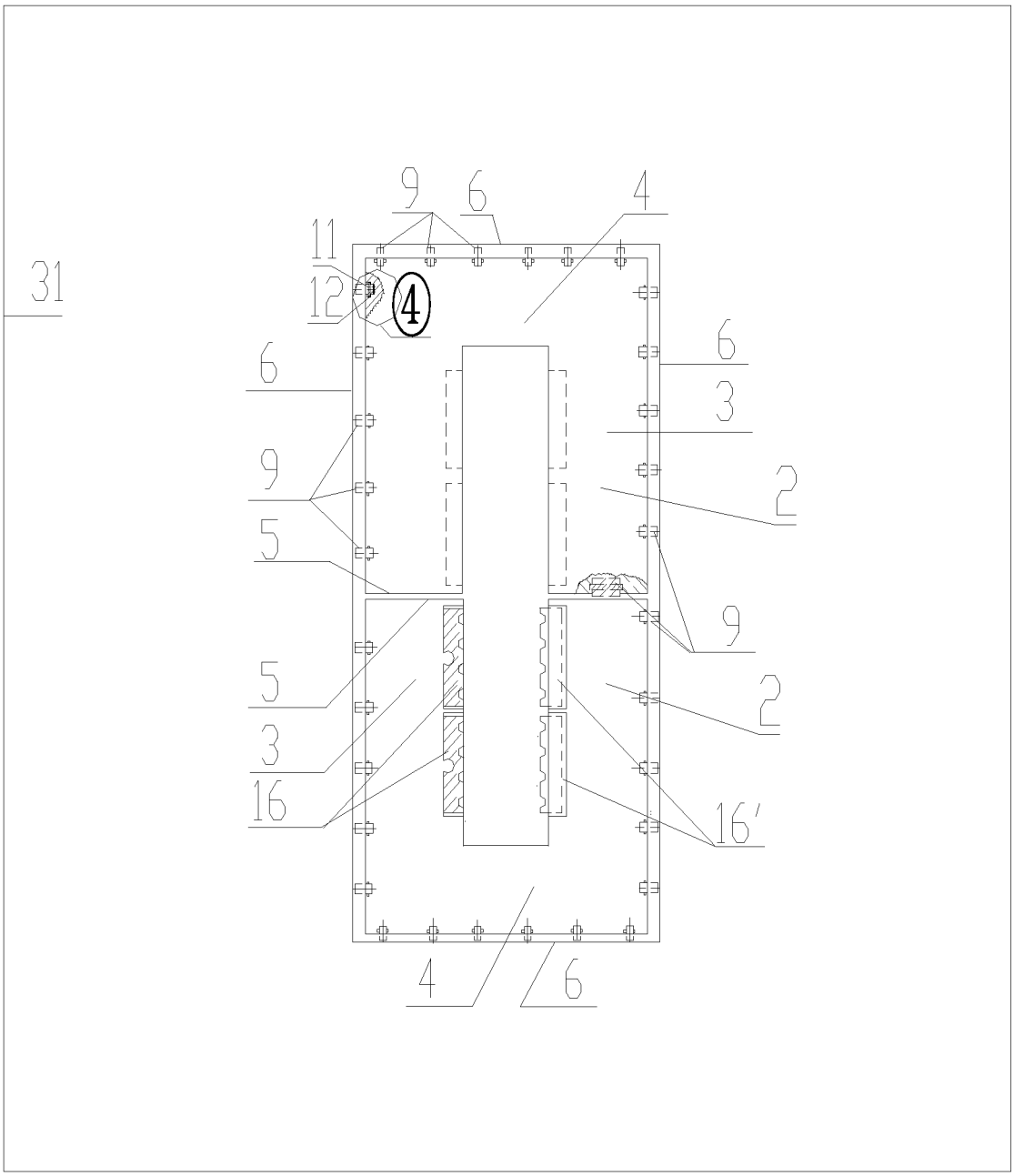
FIG. 4 shows a sectional view along C-C line in FIG. 3.
Figure 5:
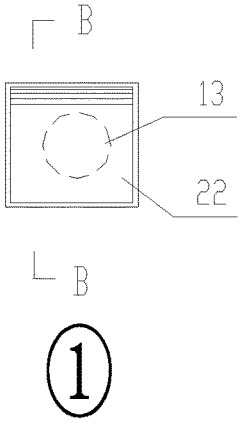
FIG. 5 shows a front view ① of a rectangular active clamping plate.
Figure 6:
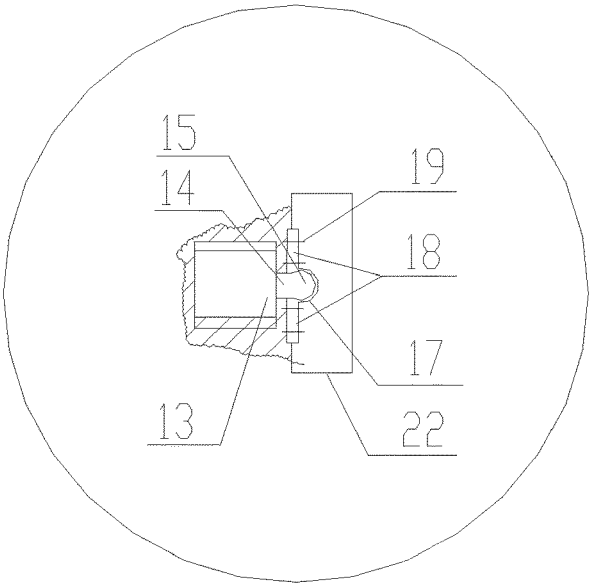
FIG. 6 shows a sectional view along the B-B line in FIG. 5.
Figure 7:
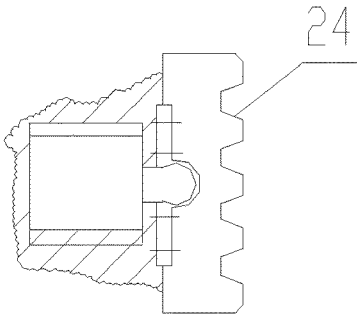
FIG. 7 shows a sectional view of a trapezoidal passive clamping plate.
Figure 8:
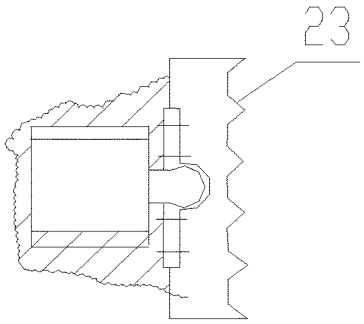
FIG. 8 shows a sectional view of a wave-shaped active clamping plate.

As shown in FIG. 1, FIG. 2, FIG. 3, and FIG. 4, a multifunctional wall-clamping device of a static pile machine (i.e., static pile driver) includes a wall-clamping rig (wall-clamping platform) 1, a machine main body 31, and a wall-pressing device. The machine body (main body) 31 has a center vertical through hole 6 (main body hole). The wall-pressing device comprises a wall pressing hydraulic cylinder 7, an upper support 25, and a lower support 26. The wall-pressing device is arranged on the main body 31. As shown in FIG. 1 or FIG. 4, the wall-clamping rig 1 comprises two pincer-like boxes 2 of the same dimensions, and each having a "concave" or U-shaped horizontal cross section. The openings of the U-shaped concaves are arranged to face each other coaxially to form a rectangular shaped cross section. Rollers or rolling wheels 9 are provided on the outside walls of the U-shaped pincer-like boxes 2. The top of the wall-clamping rig 1 is hingedly connected with the piston rod 8 of the wall-pressing cylinder 7, thereby the wall-clamping rig 1 is vertically suspended in the main body hole 6 of the machine body. The wall-clamping rig 1, aided by the roller (or rolling wheel) 9 and the wall-pressing device, can move up and down in the main body hole 6 along the inner sides of the rectangular pillar 30 of the upper support.

Figure 2:
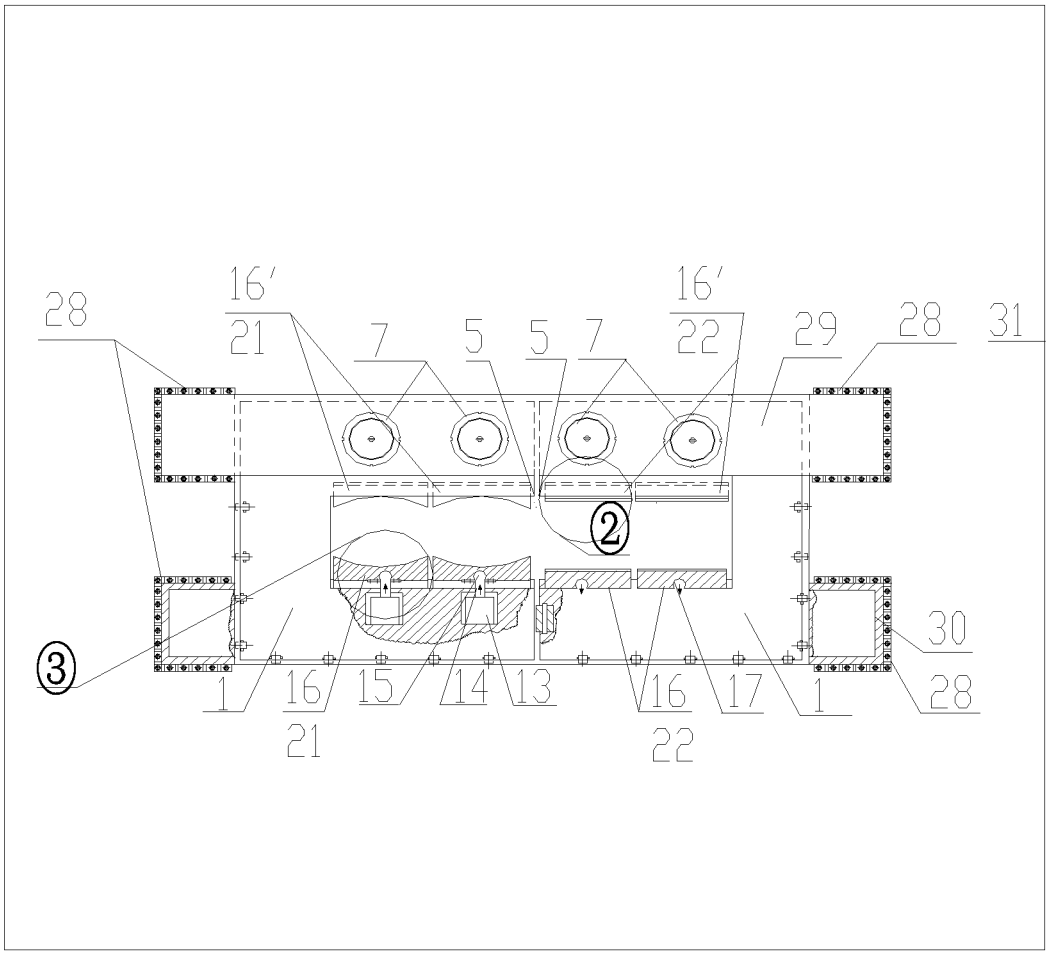
FIG. 2 shows a top view of a multifunctional wall-clamping equipment.
Figure 3:
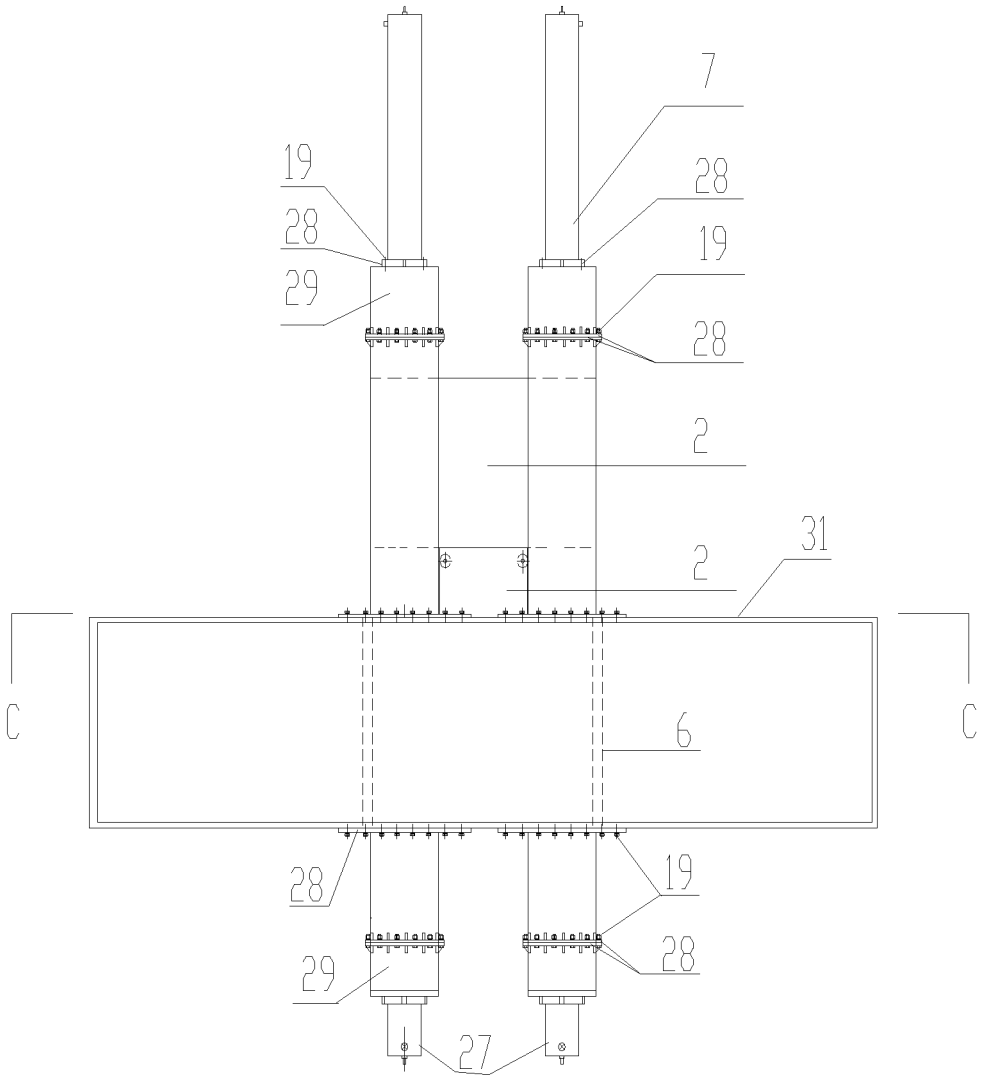
FIG. 3 shows a left-side view of the equipment in FIG. 1.

As shown in FIG. 2 or FIG. 4, the U-shaped pincer-like box (clamp) 2 of the wall-clamping rig 1 has two clamp arms 3 (i.e., the two sides of the "U") and one bottom end 4 (i.e., the bottom portion of "U"). The end of the clamp arm 3 at the opening end (i.e., the opening of the "U") is a clamp end 5. The clamp end 5, the clamp arm 3, and the bottom end 4 constitute a single U-shaped clamp 2. The dimensions of the "U-shaped" clamp are: arm (i.e., two sides of the "U") length 500 mm-2500 mm, clamp body (i.e., bottom portion of the "U") width 450 mm-2000 mm, and vertical height of the "U-shaped" clamp 800-4500 mm. The wall-clamping rig 1 has a four-side outer wall conforming to the inner walls of the main body hole 6. The U-shaped clamp 2 is made of a combination of steel plates, and the internal force-bearing locations are welded to supporting ribs 10 to form a lattice of the rectangular rigid structure.

Figure 11:
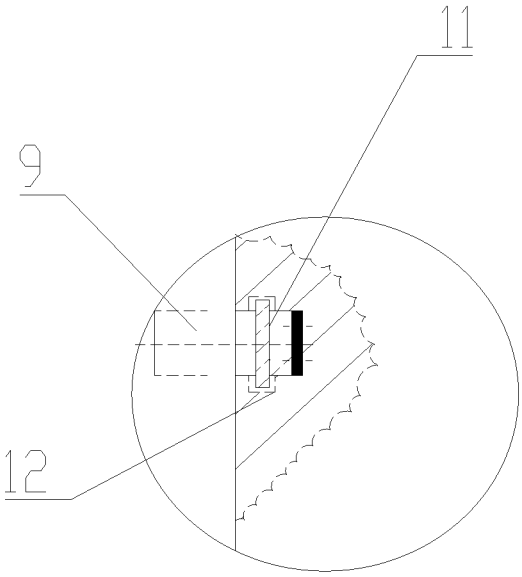
FIG. 11 shows an enlarged partial sectional view ④ of a rolling wheel.

As shown in FIG. 1, FIG. 4, and FIG. 11, a set of rollers (or rolling wheels) 9 are evenly arranged at a select distance along the horizontal and vertical directions on the four sides of the wall-clamping platform/rig 1 that contact the side walls of the through hole 6. The rolling wheel (roller) 9 is of a cylinder shape, the axis of which is provided with a roller axle 11 such that the rolling wheel 9 is free to rotate around the roller axle 11 under an external force. Both ends of the roller axle 11 are arranged in an outer wall bearing seat 12 on the outside of the wall clamping rig 1. The surface of the rolling wheel 9 protrudes sideways and abuts the inner wall of the main body hole 6. The roller axle 11 can be finely adjusted horizontally in a certain range within the bearing seat 12 to compensate for excessive gap, between the rolling wheels and the inners walls of the main body hole 6 and the upper bracket, due to progressive wear of the rolling wheel surface, thereby preventing excessive deviations when the wall-clamping rig 1 moves up and down. The opposing faces of the two pairs of clamp end 5 are provided with equally spaced rolling wheels 9, thereby converting the gliding friction into rolling friction on the clamp ends 5.

Figure 9:
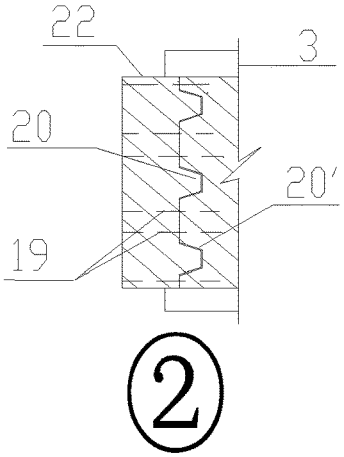
FIG. 9 shows an enlarged partial view ② of a passive clamping plate.
Figure 10:
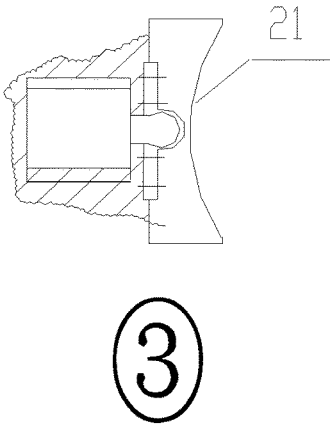
FIG. 10 shows a sectional view ③ of an arch active clamping plate.

As shown in FIG. 1, FIG. 2, or FIG. 9, a horizontal jacking cylinder 13 is arranged on the inner side of a clamp arm 3 of the U-shaped clamp 2. The front end of a horizontal jacking cylinder piston 14 is a piston rod ball head 15. The piston rod ball head 15 is hingedly attached to the back of an active clamp plate 16 at the corresponding location such that the piston rod ball 15 is inserted in a concave hemispherical hole 17 provided on the back of the active clamp plate 16, and the other half of the piston rod ball head 15 is in a hemispheric chamber formed with two hemispherical cover plates 18 that has a certain thickness and are fixed on the neck of the piston rod ball head 15 using bolts 19 fixing the hemispherical cover plates 18 on the back of the active clamp plate 16. A center hole formed by the two hemispherical cover plates 18 have a diameter larger than that of the horizontal jacking cylinder piston 14 but smaller than the diameter of the piston rod ball head 15 such that the piston rod ball head 15 cannot slip out but can rotate in all directions. As shown in FIG. 9, a corresponding inner wall of the other clamp arm 3 is provided with a passive clamp plate 16' having trapezoidal ridge 20 on its back in horizontal direction. The ridge 20 corresponds to (i.e., match) the trapezoidal convex grooves 20' on the inner side wall of the clamp arm 3. The number of the active clamp plate 16 and passive clamp plate 16' are the same number, and they have the same sizes and also have the same dimensions and profiles. The horizontal jacking cylinders 13 are provided along the inner side wall of the clamp arm 3, with at least two rows vertically and each row having at least one horizontally. In an effective area corresponding to an active clamp plate 16, there may be a single horizontal jacking cylinder 13, two horizontal jacking cylinders 13', three horizontal jacking cylinders 13", and many horizontal jacking cylinders 13'. More than one set of multiple horizontal jacking cylinders 13' can evenly distribute the reaction forces on the active clamp plate 16, and on-site installation and maintenance would be easy and convenient.

When the piston 14 of the horizontal jacking cylinder is extended, the active clamp plate 16 is pushed horizontally towards the passive clamp plate 16' so that the horizontal distance between the two clamp plates is gradually reduced, thereby gradually tightening the grip on the object between the two clamp plates. When piston 14 of the horizontal jacking cylinder retracts, the horizontal movement of the active clamp plate 16 moves it away from the passive plate 16' leading to an increase in the distance between the two clamp plates and loosening on the grip on the object held therebetween.

The clamping surfaces of the active clamp plate 16 and passive clamp plate 16' have a shape that corresponds to a profile of a clamped object. The clamping plates may include arc-shaped clamping plate 21, rectangle clamping plate 22, wave-shape clamping plate 23, trapezoidal clamping plate 24, or any other unique shaped clamping plate. Arc-shaped clamping plates 21 are used to clamp cylindrical piles. Rectangular clamping plates 22 are used to clamp rectangular pile or rectangular wall-forming device. Wave-shaped clamping plate 23 and trapezoidal clamping plate 24 are respectively used to clamp wave-shaped or trapezoidal wall-forming device or other objects. Unique shaped clamping plates are mainly designed for those with unique profiles. The active and passive clamping plates may be of different thicknesses, such that they can be interchanged to fit the clamping objects with different geometric sizes.

The wall-pressing device comprises a wall-pressing hydraulic cylinder 7, an upper support (bracket) 25, a lower support 26, and a jacking hydraulic cylinder 27. The bottom of the wall-pressing hydraulic cylinder 7 is fixed on a longitudinal beam 29 of the upper support 25 by flanges 28. The two pincer-like boxes 2 are divided into two groups, each group having at least one wall-pressing hydraulic cylinder. The wall-pressing hydraulic cylinder piston rod ball head 15' and the hemispherical concave ring 17' on the top face of the pincer-like box are hingedly connected. The hinge connection type is the same as that of the hemispherical concave ring 17 on the back of the active clamp plate 16 and the piston rod ball head 15 of the horizontal cylinder 13. Therefore, the wall-clamping rig 1 is hinged vertically in the main body hole 6 by the piston rod 8 of the wall-pressing hydraulic cylinder 7, which is mounted on the vertical beam 29 of the upper support 25. Thus, by controlling the extension or retraction of the piston rod 8, the pincer-like box 2 can be moved up and down. When a single pincer-like box 2 and the corresponding wall-pressing hydraulic cylinder 7 move, only the single pincer-like casing 2 is moved up and down, via rolling actions of the rolling wheels 9, along the inner walls of the main body hole 6 and the corresponding inner wall of the upper support rectangular column 30, while the other pincer-like box (casing) 2 remains in place. When two pincer-like boxes 2/2 and the corresponding wall-pressing hydraulic cylinders 7/7 move at the same time, if the horizontal hydraulic cylinder 13 extends out to clamp a pile or two piles or two wall-forming devices, then the two pincer-like casings 2/2 can be driven in a manner that the clamp ends 5 can move in synchronous motions in the same direction, or synchronous motions in the reverse directions, or asynchronous motions in the same direction, or asynchronous motions in the reverse directions, to achieve multi-functional missions of the wall-clamping platform.

The upper support 25 comprises two parallel longitudinal beams 29 arranged in the direction of the clamp arm 3 of the pincer-like boxes 2, which are arranged in a coaxial configuration. The longitudinal beam 29 is longer in span than the sum of the lengths of two clamp arms 3 of the two pincer-like casings 2 that are arranged coaxially. The spacing between the two parallel longitudinal beams 29 is slightly larger than the length of the clamp bottom 4. The ends of the longitudinal beams 29 are fixed on the top of the rectangular column 30 by flanges 28. The bottom of the rectangular column 30 is fixed on the main body 31 near the main body hole 6 by flanges 28. This forms two door-shaped upper supports 25 that are arranged in parallel and are of the same dimensions and the same shape. The span and the parallel spacing of the longitudinal beams 29 of the upper bracket 25 are designed such that it can accommodate a member of the maximum cross-section and allow it to move freely up and down or in the axial direction or to move horizontally in the axial direction. The height of the upper support 25 is larger than the length of the wall-pressing cylinder 7 itself plus the piston rod 8 total stroke length.

The lower support 26 is disposed on bottom face of the main body 31 around the edge of the main body hole 6 at a location corresponding to the upper support 25. Using bolts 19 to fix flanges 28 at both ends of a lower longitudinal beam 29' respectively with the lower support 26 and the bottom of the lower rectangular column 30', thereby connecting the lower support 26 with the lower rectangular column 30'. The upper end of the lower rectangular column 30' is fixed via flange 28 and bolt 19 at the bottom of main body 31 to form an inverted door-shaped (i.e., "U" shaped) structure. The spans of the two lower longitudinal beams 29' and the parallel spacing between them match those of the two longitudinal beams 29 of the upper support 25 at the top of the main body 31. The heights of the two lower longitudinal beams 29' should be as follows: the bottom of lifting hydraulic cylinder (jacking cylinder) 27 should have sufficient clearance from the ground such that the static pile driver would have sufficient clearance from the ground when moving. The jacking cylinder 27 is mounted by means of a flange 28 perpendicular to the bottom end of the lower longitudinal beam 29' by means of bolts 19, at a location corresponding to underneath the clamp arm 3, such that the piston rod 8' of the jacking cylinder 27 faces up and can pass through a hole in the lower longitudinal beam 29' in the up and down motion. The piston rod 8' of the jacking cylinder 27 at its front end has a rectangular pad/block 32 that is larger in dimension than the area of the jacking piston rod 8'. When the piston rod 8' of the jacking cylinder is extended, the clamp arm 3 of the pincer-like casing 2 is jacked up by the rectangular pad 32, by an upward pushing force through the lower support 26. This can serve as an auxiliary force to assist the wall-pressing cylinder 7 when increased force is needed to pull out the wall-forming device and other components. The longitudinal beam 29 of the upper support 25, the rectangular column 30, and the lower longitudinal beam 29' of the lower support 26, and the lower rectangular column 30' all have the same cross-section areas, but differ in the length of the upper and lower rectangular columns 30/30'.

What is claimed is:

1. A multifunctional wall-clamping device for a static pile driver, comprising:

A wall-clamping platform (1), a main body (31), and a wall-pressing device, wherein the main body (31) has a center hole (6), wherein the wall-pressing device, disposed on the main body (31), comprises a wall-pressing hydraulic cylinder (7) disposed on an upper support (25), a jacking cylinder (27) disposed on a lower support (26), wherein the wall-clamping platform (1) comprises two U-shape pincer boxes (2) with a same geometry and a U-shaped horizontal cross section, the two U-shape pincer boxes are arranged with openings facing each other on the same axis to form a combination with a rectangular cross section, wherein a piston rod (8) of the wall-pressing hydraulic cylinder (7) is hingedly connected to a top of the wall-clamping platform (1) such that the wall-clamping platform (1) is vertically suspended in the center hole (6), wherein outside walls of the wall-clamping platform (1) comprise roller wheels (9), which can roll on inner walls of the center hole (6) and inner walls of rectangular columns (30) of the upper support and the lower support, when the wall-clamping platform (1) moves up and down by action of the wall-pressing hydraulic cylinder (7).

2. The multifunctional wall-clamping device according to claim 1, wherein two arms of the "U" in each of the U-shape pincer boxes (2) of the wall-clamping platform (1) are referred to as clamp arms (3), and that at bottom of the "U" is referred to as a clamp bottom (4), front ends of the clamp arms (3) are referred to as clamp ends (5), thereby the clamp ends (5), the clamp arms (3), and the clamp bottom (4) constitute one of the U-shape pincer boxes (2), wherein the clamp arms are 500 mm 2500 mm long, the clamp bottom (4) is 450 mm-2000 mm wide, and a vertical height of each of the U-shape pincer boxes (2) is 800 mm-4500 mm, wherein the U-shape pincer boxes (2) are made of steel plates to form a rectangular steel structure and force-bearing points therein are reinforced by welding a web of support ribs (10).

3. The multifunctional wall-clamping device according to claim 2, wherein the roller wheels (9) are arranged, in rows and columns with a fixed spacing, on four walls of the wall-clamping platform (1) in areas contacting the inner walls of the center hole (6), wherein the roller wheels (9) are column shaped and each has a roller axle (11) such that the roller wheels (9) can freely rotate around the roller axle (11) under an external force, the roller axle (11) is disposed in a roller seat (12) on external walls of the wall-clamping platform (1), the surfaces of the roller wheels (9) contact the inner walls of the center hole (6), the roller axle (11) can make adjustment within a limit to compensate for gaps, due to wear, between the roller wheels (9) and the inner walls of the center hole (6), the roller wheels are also provided on faces of the clamp ends (5) to convert surface friction into rolling friction.

4. The multifunctional wall-clamping device according to claim 2, wherein a horizontal jacking cylinder (13) is disposed on an inner wall of one of the clamp arms (3) of the U-shape pincer boxes (2), a front end of a piston (14) of the horizontal jacking cylinder is a piston ball head (15), which is hingedly connected with a hemispherical indent (17) on the back surface of an active clamping plate (16), wherein the hinge connection of the piston ball head (15) is accomplished using two hemispherical cover plates (18) that form a center passage with a diameter larger than a diameter of the piston (14) but smaller than a diameter of the piston ball head (15) such that the piston ball head (15) cannot fall off, but can rotate, wherein the hemispherical cover plates (18) are fixed using bolts (19) on the back surface of the active clamping plate (16), wherein a passive clamping plate (16') is arranged on the other clamp arm (3), by having a horizontal trapezoidal track (20) fit into a trapezoidal groove (20') on the other clamp arm (3) and fixed with bolts (19) to prevent movement, the active clamping plate (16) and the passive clamping plate (16') have the same number, correspond to the same location, and have the same dimensions and profiles, wherein the horizontal jacking cylinders (13) are arranged on the inner side of clamp arm (3) in at least two rows, with each row having at least one, within an effective area of the active clamping plate (16) there can be a single horizontal jacking cylinder (13), double horizontal jacking cylinders (13'), three horizontal jacking cylinders (13"), and multiple horizontal jacking cylinders (13''').

5. The multifunctional wall-clamping device according to claim 4, wherein clamping surfaces of the active clamping plate (16) and the passive clamping plate (16') have a shape corresponding to that of an article to be clamped, the shape includes an arc shape (21), a rectangular shape (22), a wavy shape (23), a trapezoidal shape (24), or a special shape, wherein the arc shape (21) is for clamping a round cylinder pile, the rectangular shape (22) is for clamping a rectangular pile or a rectangular wall-forming device, the wavy shape (23) and the trapezoidal shape (24) are for clamping a corresponding wavy or trapezoidal wall-forming device component, the special shape is designed for an object having the special shape, the active and passive clamping plates are made in several thicknesses so that they can be replaced to fit the dimensions of a clamped object.

6. The multifunctional wall-clamping device according to claim 1, wherein the wall-pressing device includes the wall-pressing hydraulic cylinder (7), the upper support (25), the lower support (26), and a jacking cylinder (27), wherein a bottom of the wall-pressing hydraulic cylinder (7) is fixed, via a flange (28), on a cross beam (29) of the upper support (25), wherein the two U-shape pincer boxes (2) are divided into two groups, each having at least one wall-pressing hydraulic cylinder, a piston rod ball head (15') of the wall-pressing hydraulic cylinder is hingedly connected at a concave hemispherical hole (17') on a top face of one of the two U-shape pincer boxes (2), the connection mode is the same as that connecting the piston rod ball (15) of the horizontal jacking cylinder (13) and the hemispherical (17) on the back of the active clamping plate (16), wherein each of the two U-shape pincer boxes (2) is vertically suspended in the center hole (6) via the piston rod (8) of the wall-pressing hydraulic cylinder (7), by controlling the piston rod (8), the two U-shape pincer boxes (2) can move up and down individually or in combination, wherein one of the two U-shape pincer boxes (2) can be driven by the corresponding wall-pressing hydraulic cylinder (7) to move up and down in the center hole (6) by having the roller wheels (9) roll on the inner walls of the center hole (6) and the inner walls of rectangle columns (30), while the other of the two U-shape pincer boxes (2) remains stationary, whereas when both of the two U-shape pincer boxes (2,2) are driven by the corresponding wall-pressing hydraulic cylinders (7,7) at the same time, the horizontal jacking cylinders (13) can be used to clamp a pile or two piles or two wall-forming devices, the clamp ends (5) of the two U-shape pincer boxes (2,2) can be driven to move in synchronous or asynchronous manner and in the same or opposite directions to achieve multiple functions of the wall-forming platform.

7. The multifunctional wall-clamping device according to claim 6, wherein the upper support (25) comprises two cross beams (29) arranged in parallel along a direction of the clamp arms (3) of the two U-shape pincer boxes (2), a span of the longitudinal beams is greater than a sum of lengths of the two clamp arms (3), a parallel spacing between the two cross beams (29) is slightly larger than a width of the clamp bottom (4), the ends of the two cross beams (29) are fixed on top of the rectangular columns (30), bottoms of the rectangular columns (30) are fixed with flanges (28) at locations proximate an edge of the center hole (6) of the main body (31), forming the upper support (25) that comprises two parallel structures having an identical size and shape, the span and the parallel spacing of the two cross beams (29) of the upper support (25) can accommodate a maximum cross section of a selected object to allow the selected object to freely move up and down or move horizontally in the axial direction;

a total height of the upper support (25) is larger than a sum of a length of the wall-pressing hydraulic cylinder (7) and a distance for a full stroke of the piston rod (8).

8. The multifunctional wall-clamping device according to claim 7, wherein the lower support (26) is disposed at the edge of the center hole (6) at a position corresponding to the position of the upper support (25), the lower support (26) is fixed, via a flange (28) thereof, to a lower cross beam (29'), and the bottom end of a lower rectangular column (30') using bolts (19), and the upper end of the lower rectangular column (30') is bolted, via a flange (28) thereof, to the bottom end surface of the main body (31) to form an inverted door structure, the bottom of the jacking cylinder (27) having a ground clearance to allow the static pile driver required to travel on the ground, the jacking cylinder (27), via a flange thereof, is fixed, using bolts, to the bottom of the lower cross beam (29') at a location corresponding to the clamp arms (3), a piston rod (8') of the jacking cylinder (27) faces upward and can move vertically through a precut hole in the lower cross beam (29'), when the piston rod (8') of the jacking cylinder is extended, the piston rod (8') pushes a rectangular spacer (32) against the bottom surface of the clamping arm (3) to produce an upward thrust mediated by the lower support (26), and the cross beams (29) on the upper support (25), the upper rectangular columns (30), the cross beams (29') on the lower support (26), and the lower rectangular columns (30') have the same cross-section, but the upper rectangular columns (30) and the lower rectangular columns (30') have different lengths.

* * * * *